US007737863B2

(12) United States Patent
Jin et al.

(10) Patent No.: US 7,737,863 B2
(45) Date of Patent: Jun. 15, 2010

(54) COMMON INTERFACE ARCHITECTURE FOR HORIZONTAL DIRECTIONAL DRILLING MACHINES AND WALK-OVER GUIDANCE SYSTEMS

(75) Inventors: Jeremy Jin, Pella, IA (US); Scott Rempe, Pella, IA (US)

(73) Assignee: Vermeer Manufacturing Company, Pella, IA (US)

( * ) Notice: Subject to any disclaimer, the term of this patent is extended or adjusted under 35 U.S.C. 154(b) by 601 days.

(21) Appl. No.: 11/803,724

(22) Filed: May 15, 2007

(65) Prior Publication Data

US 2008/0030366 A1 Feb. 7, 2008

Related U.S. Application Data

(63) Continuation of application No. 10/253,378, filed on Sep. 24, 2002, now Pat. No. 7,218,244.

(60) Provisional application No. 60/324,655, filed on Sep. 25, 2001.

(51) Int. Cl.
*G01V 3/00* (2006.01)

(52) U.S. Cl. ..... 340/853.3; 340/853.4; 175/26; 175/45; 175/61

(58) Field of Classification Search ..... 340/853.3, 340/853.4; 175/26, 45, 61
See application file for complete search history.

(56) References Cited

U.S. PATENT DOCUMENTS 4,646,277 A 2/1987 Bridges et al.
4,881,083 A 11/1989 Chau et al.
5,165,490 A 11/1992 Nosaka
5,182,516 A 1/1993 Ward et al.
5,363,926 A 11/1994 Mizuno
5,425,179 A 6/1995 Nickel et al.
5,467,832 A 11/1995 Orban et al.
5,469,155 A 11/1995 Archambeault et al.
5,553,245 A 9/1996 Su et al.
5,585,726 A 12/1996 Chau
5,698,981 A 12/1997 Mercer
5,703,484 A 12/1997 Bieberdorf et al.
5,711,381 A * 1/1998 Archambeault et al. ..... 175/45

(Continued)

FOREIGN PATENT DOCUMENTS

GB 2175096 11/1986

(Continued)

*Primary Examiner*—Timothy Edwards, Jr.
(74) *Attorney, Agent, or Firm*—Hollingsworth & Funk, LLC

(57) ABSTRACT

A system and method of interfacing a drilling machine with one of a number of different walk-over guidance systems involves receiving an ID signal from a particular walk-over guidance system selected for use with the drilling machine. A protocol library associated with the particular walk-over guidance system is accessed in response to the ID signal. The protocol library is used to effect communication between the particular walk-over guidance system and a control system of the drilling machine during cooperative use of the particular walk-over guidance system and drilling machine. Using the protocol library involves converting, as prescribed by the protocol library, locator signals received from the particular walk-over guidance system from a locator protocol to a common protocol used by the control system of the drilling machine. Locator and drilling machine data of various types can be presented to a drilling machine operator via an on-board display.

20 Claims, 5 Drawing Sheets

U.S. PATENT DOCUMENTS

| | | | | |
|---|---|---|---|---|
| 5,720,354 | A | 2/1998 | Stump et al. | |
| 5,764,062 | A | 6/1998 | Mercer | |
| 5,767,678 | A | 6/1998 | Mercer | |
| 5,778,991 | A | 7/1998 | Rimqiost et al. | |
| 5,819,859 | A | 10/1998 | Stump et al. | |
| 5,850,624 | A | 12/1998 | Gard et al. | |
| 5,880,680 | A | 3/1999 | Wisehart et al. | |
| 5,904,210 | A | 5/1999 | Stump et al. | |
| 5,933,008 | A | 8/1999 | Mercer | |
| 5,961,252 | A | 10/1999 | Mercer et al. | |
| 6,008,651 | A | 12/1999 | Mercer | |
| 6,014,026 | A | 1/2000 | Mercer | |
| 6,035,951 | A | 3/2000 | Mercer et al. | |
| 6,047,783 | A | 4/2000 | Mercer et al. | |
| 6,079,506 | A | 6/2000 | Mercer | |
| 6,095,260 | A | 8/2000 | Mercer et al. | |
| 6,102,136 | A | 8/2000 | Archambeault et al. | |
| 6,160,401 | A | 12/2000 | Mercer | |
| 6,161,630 | A | 12/2000 | Stump et al. | |
| 6,191,585 | B1 | 2/2001 | Mercer et al. | |
| 6,202,012 | B1 | 3/2001 | Gile et al. | |
| 6,232,780 | B1 | 5/2001 | Mercer | |
| 6,250,402 | B1 | 6/2001 | Brune et al. | |
| 6,267,185 | B1 * | 7/2001 | Mougel et al. | 175/57 |
| 6,279,668 | B1 | 8/2001 | Mercer | |
| 6,308,787 | B1 | 10/2001 | Alft | |
| 6,315,062 | B1 | 11/2001 | Alft et al. | |
| 6,389,360 | B1 | 5/2002 | Alft et al. | |
| 6,408,952 | B1 | 6/2002 | Brand et al. | |
| 6,491,115 | B2 | 12/2002 | Houwelingen et al. | |
| 6,651,755 | B1 * | 11/2003 | Kelpe | 175/26 |
| 7,218,244 | B2 | 5/2007 | Jin et al. | |

FOREIGN PATENT DOCUMENTS

| | | |
|---|---|---|
| WO | WO 01/51760 A2 | 7/2001 |

* cited by examiner

COMMON INTERFACE ARCHITECTURE FOR HORIZONTAL DIRECTIONAL DRILLING MACHINES AND WALK-OVER GUIDANCE SYSTEMS

RELATED APPLICATIONS

This application is a continuation of U.S. patent application Ser. No. 10/253,378 filed on Sep. 24, 2002, to issue as U.S. Pat. No. 7,218,244 on Mar. 15, 2007, which claims the benefit of Provisional Patent Application Ser. No. 60/324,655, filed on Sep. 25, 2001, to which Applicant claims priority under 35 U.S.C. §120 and 35 U.S.C. §119(e), respectively, and which are incorporated herein by reference in their entirety.

FIELD OF THE INVENTION

The present invention relates generally to the field of underground boring and, more particularly, to a system and method for integrating a drilling machine with a number of disparate systems that cooperate with the drilling machine, such as walk-over guidance systems, using a common communications/control interface architecture and methodology.

BACKGROUND OF THE INVENTION

Utility lines for water, electricity, gas, telephone, and cable television are often run underground for reasons of safety and aesthetics. In many situations, the underground utilities can be buried in a trench which is then back-filled. Although useful in areas of new construction, the burial of utilities in a trench has certain disadvantages. In areas supporting existing construction, a trench can cause serious disturbance to structures or roadways. Further, there is a high probability that digging a trench may damage previously buried utilities, and that structures or roadways disturbed by digging the trench are rarely restored to their original condition. Also, an open trench may pose a danger of injury to workers and passersby.

The general technique of boring a horizontal underground hole has recently been developed in order to overcome the disadvantages described above, as well as others unaddressed when employing conventional trenching techniques. In accordance with such a general horizontal boring technique, also known as horizontal directional drilling (HDD) or trenchless underground boring, a boring system is situated on the ground surface and drills a hole into the ground at an oblique angle with respect to the ground surface. A drilling fluid is typically flowed through the drill string, over the boring tool, and back up the borehole in order to remove cuttings and dirt. After the boring tool reaches a desired depth, the tool is then directed along a substantially horizontal path to create a horizontal borehole. After the desired length of borehole has been obtained, the tool is then directed upwards to break through to the earth's surface. A reamer is then attached to the drill string which is pulled back through the borehole, thus reaming out the borehole to a larger diameter. It is common to attach a utility line or other conduit to the reaming tool so that it is dragged through the borehole along with the reamer.

Another technique associated with horizontal directional drilling, often referred to as push reaming, involves attaching a reamer to the drill string at the entry side of a borehole after the boring tool has exited at the exit side of the borehole. The reamer is then pushed through the borehole while the drill rods being advanced out of the exit side of the borehole are individually disconnected at the exit location of the borehole.

A push reaming technique is sometimes used because it advantageously provides for the recycling of the drilling fluid. The level of direct operator interaction with the drill string, such as is required to disconnect drill rods at the exit location of the borehole, is much greater than that associated with traditional horizontal directional drilling techniques.

The process of horizontal directional drilling has undergone significant development over the past two decades. These developments have involved the drilling machines and the location detection and directional control components. Several types of location detection and directional control systems have been utilized, with today's walk-over guidance systems becoming the most accepted technology. As the guidance/locator technology is quite different than the mechanical technology utilized in developing the drilling machines, in most instances companies have developed either the drilling machine or the guidance systems, but typically not both. As a result, there are now several suppliers of walk-over guidance systems, each with unique features, that are used with the variety of drilling machines.

Early in the development of horizontal directional drilling technology, it was recognized that there was a potential to incorporate location information, as generated from a remote electronic component and transferred via radio signals or hard wire, into the control of the drilling machines. Examples of this include U.S. Pat. Nos. 4,646,277 and 4,881,083, and GB 2175096, which are hereby incorporated herein by reference in their respective entireties. These systems were primarily configured as bore-to-target systems where the remote electronic component was placed at a position near a destination point. This remote electronic component then cooperated with the drilling machine, and specifically with an electronic component mounted in the drill head, with each individual component integral to the control system.

These systems provided varying degrees of success in directing a cutting tool to a target point, but did not provide accurate continuous information about the location of the cutting tool. Close monitoring of the cutting tool's location as it passes near to various underground objects at all points of the bore is generally considered critical to the overall process. Thus, the systems that operated in a manner to guide the cutting tool to a target turned out to be less useful than systems wherein cutting tool location was continuously monitored. These systems, referred to today as walk-over guidance systems, have been developed to provide a continuous or quasi-continuous monitoring capability. Several patents have been issued disclosing various aspects of the locating systems of the walk-over guidance systems, including U.S. Pat. Nos. 6,232,780; 6,008,651; 5,767,678; 5,880,680; 5,703,484; 5,425,179; 5,850,624; 5,711,381; 5,469,155; 5,363,926; and 5,165,490, which are hereby incorporated herein by reference in their respective entireties.

Other technologies are capable of providing information about travel of the drill head, including the use of gyroscopes, accelerometers, magnetometers, etc., in various types of dead-reckoning techniques or other techniques including establishing an electromagnetic field to be sensed by the drill head's electronics. In most cases, data from such sensors is typically transferred by what is known as a wire line, where an actual wire conductor extends within the drill pipe from the drilling bit back to the drilling machine. This wire enables transmission of data at higher rates than systems that rely on radio communications.

A major concern with this technology is accuracy, since as a borehole is extended a substantial distance, any small deviation at each reading point can be amplified, and if not corrected, eventually result in significant errors. One patent, U.S.

Pat. No. 5,585,726, which is hereby incorporated herein by reference in its entirety, discloses a technique of utilizing both today's walk-over guidance technology and newer guidance technologies in conjunction. A difficulty in incorporating this technique is the variation in manufacturers of the wire line-based guidance packages which, when combined with variations in manufacturers of walk-over guidance systems, creates a situation where it will be difficult to integrate all necessary and/or desired information.

As the technology using walk-over guidance systems continues to evolve, the advantages of coordinating/integrating the information generated by the walk-over guidance systems into the overall control system of the drilling machine are becoming evident. A first step in this evolution has involved the transfer and display of information from the walk-over guidance systems to the drilling rig. Several patents disclosing this transfer of information have been issued, including U.S. Pat. Nos. 5,469,155; 5,711,381; 6,102,136; and 6,191,585, which are hereby incorporated herein by reference in their respective entireties.

Further integration developments include the capability of issuing machine commands to the drilling machine from a remote electronic component. Several patents disclosing such capabilities include U.S. Pat. Nos. 6,079,506; 6,279,668; and 6,408,952, which are hereby incorporated herein by reference in their respective entireties.

Another aspect of integrating the controls includes providing an indication of how the current location of the bore compares to the desired location, and providing a correction. Several exemplary patents include U.S. Pat. Nos. 5,698,981; 5,764,062; and 5,933,008, which are hereby incorporated herein by reference in their respective entireties.

Still further aspects of integration dealing with real time feedback and control are disclosed in various U.S. patents and U.S. and PCT applications including U.S. Pat. Nos. 6,308,787; 6,315,062; now U.S. Pat. Nos. 6,491,115; 5,778,991; 5,720,354; 5,819,859; 5,904,210; 6,161,630; 6,435,286; published PCT application WO 01/51760 A2; U.S. Pat. Nos. 6,250,402; 6,095,260; 6,047,783; 6,035,951; 6,191,585; 6,160,401; and 6,014,026, which are hereby incorporated herein by reference in their respective entireties.

Integration of the controls is ultimately aimed at enabling the actual boring process to remain on plan. Several patents disclosing various aspects involved with establishing a bore plan and then performing the bore, including location determination and machine control, have been issued, including U.S. Pat. Nos. 6,389,360 and 6,308,787; which are hereby incorporated herein by reference in their respective entireties. As bore planning becomes more common, there will be a continued desire to provide the maximum flexibility in how the bore plans are developed, how they are displayed to the operators, to allow on-the-fly adjustments of the bore plan, and increase the interactive aspects of bore planning. The interactive aspects should include the capability of the system to provide recommendations of appropriate actions.

SUMMARY OF THE INVENTION

The present invention is directed to a system and method of interfacing a drilling machine with at least one of a number of disparate components of a drilling system. According to one embodiment, an ID signal is received from a particular component of the drilling system selected for use with the drilling machine. A protocol library associated with the particular drilling system component is accessed in response to the ID signal. The protocol library is used to effect integration between the particular drilling system component and a control system of the drilling machine.

Integration between the drilling machine and a wide variety of disparate drilling system components can be effected in this manner. For example, a selected one of a number of disparate walk-over guidance systems can be integrated as part of the drilling system. Other drilling system components that can be integrated as part of the drilling system include drilling fluid dispensing systems, strike alert systems, power management systems, on-board displays, wire line tracking systems, bore planning systems, and stake down systems, among other potential components.

In accordance with another embodiment of the present invention, a method of interfacing a drilling machine with one of a number of disparate walk-over guidance systems involves receiving an ID signal from a particular walk-over guidance system selected for use with the drilling machine, and accessing a protocol library associated with the particular walk-over guidance system in response to the ID signal. The method further involves using the protocol library to effect communication between the particular walk-over guidance system and a control system of the drilling machine during cooperative use of the particular walk-over guidance system and drilling machine.

The protocol library can be used to convert, as prescribed by the protocol library, locator signals received from the particular walk-over guidance system from a locator protocol to a common protocol used by the control system of the drilling machine. For example, protocol conversion can involve mapping input and output parameters, as prescribed by the protocol library, associated with locator protocol and a common protocol used by the control system of the drilling machine to effect communication between the particular walk-over guidance system and the control system of the drilling machine.

A common communication protocol and/or communication link can be employed to integrate the components or nodes of the system. Alternatively, a number of different communication protocols and/or communication links can be employed to integrate the various components or nodes of the system.

According to another embodiment, a system of interfacing a drilling machine with one of a number of walk-over guidance systems includes a protocol module, provided at the drilling machine, that receives an ID signal from a particular walk-over guidance system selected for use with the drilling machine. The system further includes a protocol library system accessible to the protocol module. The protocol module associates the received ID signal with the particular walk-over guidance system and selects a protocol library appropriate for the particular walk-over guidance system. A control system of the drilling machine uses the protocol library to effect communication with the particular walk-over guidance system.

The above summary of the present invention is not intended to describe each embodiment or every implementation of the present invention. Advantages and attainments, together with a more complete understanding of the invention, will become apparent and appreciated by referring to the following detailed description and claims taken in conjunction with the accompanying drawings.

Figure 1:
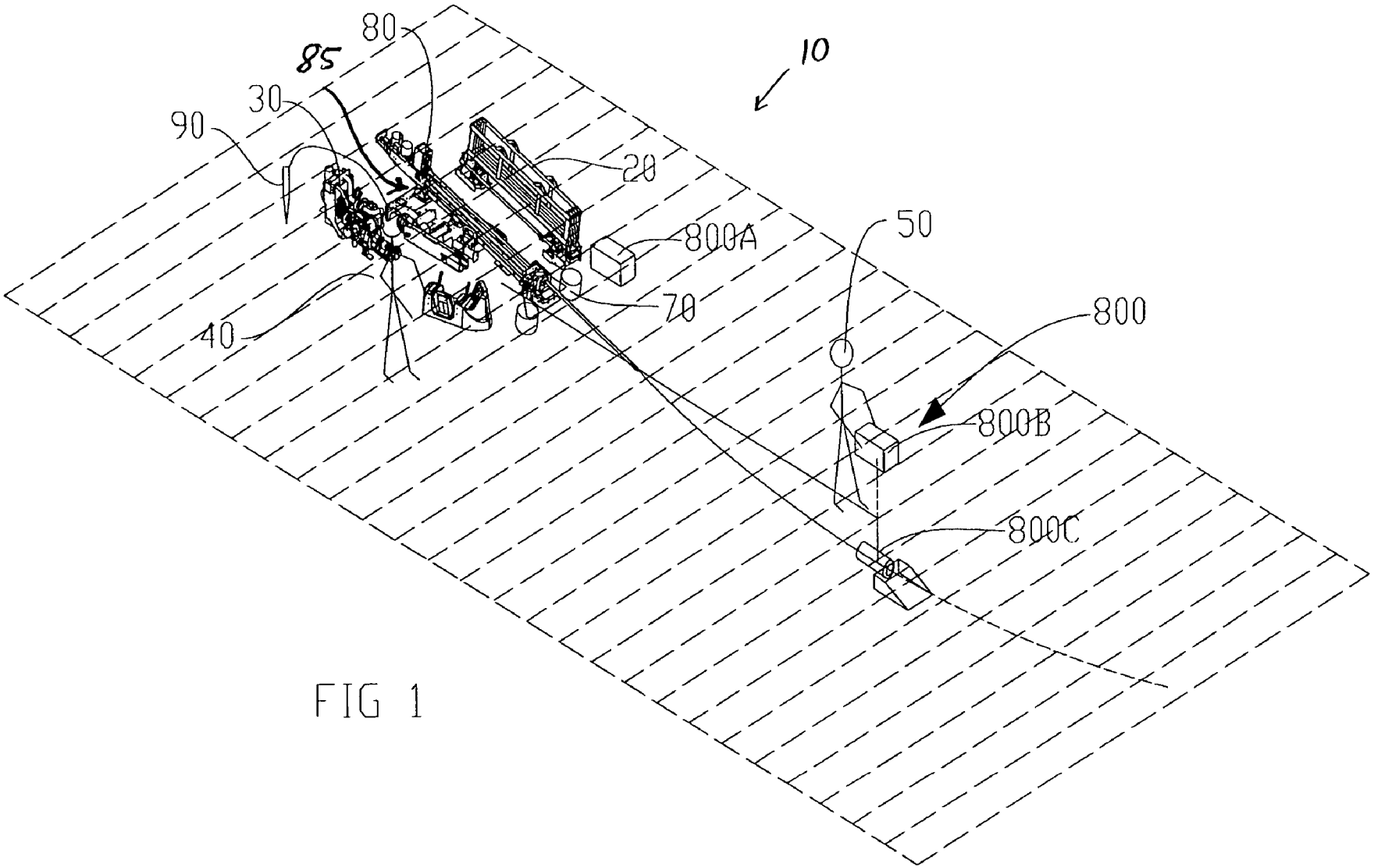
FIG. 1 illustrates various components of a drilling system, the drilling machine incorporating a component interface architecture in accordance with an embodiment of the present invention.

While the invention is amenable to various modifications and alternative forms, specifics thereof have been shown by way of example in the drawings and will be described in detail herein. It is to be understood, however, that the intention is not to limit the invention to the particular embodiments described. On the contrary, the invention is intended to cover all modifications, equivalents, and alternatives falling within the scope of the invention as defined by the appended claims.

DETAILED DESCRIPTION OF THE VARIOUS EMBODIMENTS

In the following description of the illustrated embodiments, references are made to the accompanying drawings which form a part hereof, and in which is shown by way of illustration, various embodiments in which the invention may be practiced. It is to be understood that other embodiments may be utilized, and structural and functional changes may be made without departing from the scope of the present invention.

The present invention is directed to a system and method of interfacing a drilling machine with at least one of a number of disparate components of a drilling system, such as a variety of walk-over locator systems supplied by a number of different manufacturers. In order to accommodate the needs of the operator for a given excavation project, it may be desirable that the overall control system of the drilling system provide the capability to integrate a number of disparate drilling machine elements. Such drilling machine elements may include, for example, one or more of a walk-over guidance controller, drilling machine control, a bore planning system controller, and possibly wire line-based guidance systems. Due to the variety of companies developing walk-over guidance systems and wire line guidance systems, for example, a system and methodology of the present invention that enables integration of those control components into the overall system is highly desirable. An interface architecture and methodology of the present invention provides for integration of such elements.

By way of example, each manufacturer of walk-over guidance systems has developed what is known as a remote display component, which is mounted on the drilling machine. The remote display is capable of providing information generated by the walk-over guidance systems to the operator of the drilling machine. Each manufacturer has thus developed a radio unit to communicate this information from the remote electronic component, which is the main component of the walk-over guidance system, to this remote display unit, which is mounted on the drilling machine. Each of the components offered by the various walk-over system manufacturers is unique. More particularly, the component configurations, hardware, software, communication protocols, data acquisition, transmission, and reception requirements (e.g., data content, type, and format), user features and functionality, object detection methodologies, geographic location detection capabilities, and the like are typically unique as between walk-over system manufacturers.

In order to accomplish a high level of integration between a horizontal directional drilling machine and a wide variety of walk-over guidance system configurations, and in accordance with an embodiment of the present invention, a common interface and interface methodology has been developed to allow integration of such walk-over guidance system configurations with a drilling machine. In general, a common interface and interface methodology of the present invention provides many advantages and improvements over current approaches. By way of example, and according to one configuration, a walk-over guidance system of the present invention provides for a drilling machine configured to integrate with a variety of walk-over guidance systems such that the walk-over guidance systems become an integral component of the complete control system.

In another configuration, a walk-over guidance system of the present invention enables walk-over guidance systems to maintain unique features, allowing for product distinction and accommodation of current and future user preference within the walk-over guidance system industry. In other words, the features and functionality that led a particular user to purchase a given walk-over guidance system can be preserved.

A walk-over guidance system of the present invention, according to another configuration, enables common display techniques for those parameters that are common. For example, pitch of bit, clock/roll position of bit, depth of bit, fluid pressure at bit, product tension measured at bit, and vibration at bit parameters can be displayed in a manner readily familiar to the operator.

A further configuration provides for the transmission of an E-Strike Signal and avoidance warning to a walk-over locator operator. Another configuration enhancement concerns the integration of a remote lockout capability, which advantageously results in a lowered overall cost for the system in comparison to employing separate walk-over locator and remote lockout systems.

In another configuration, a walk-over guidance system of the present invention allows drilling machine diagnostics and performance information to be transferred to the walk-over locator. Various other forms of information, such as rig operator instructions, locator download/diagnostic polling instructions, drill head instrumentation configuration and control signals, which are subsequently communicated from the locator to the drill head, and the like can be transferred to the walk-over locator from the drilling machine.

According to a further configuration, two-way communications allows as-built information to be generated at the boring machine and then transferred to the locator. Alternatively, or in addition, as-built information can be generated at the locator and then transferred to the drilling machine. Likewise, the electronics required to store a bore plan and provide updates to the bore plan can be present on the drill rig and then this data transferred to the locator, or the bore plan could be loaded or generated at the walk-over locator and then transferred to the boring machine. Also, a bore plan may be developed by another system separate from the locator or drilling machine, and subsequently transferred to the locator or the drilling machine. Adjustments to the bore plan could be made at either location.

In yet another configuration, an interface with a wire telemetry system, which could be built by a variety of manufacturers, can be provided at the electronics on the drill rig, where processing capabilities are not limited by power consumption. This will enable independent wire line systems and walk-over guidance systems, which could be built by a variety of manufacturers, to interact, such as in the manner described in U.S. Pat. No. 5,585,726. Such an interface can be used with a variety of wire line systems or other communication systems, including non-wire line telemetry systems, mud pulse systems, capacitive or inductive telemetry systems, and the like.

According to a further system configuration, bore planning software can be integrated as a system feature, and can be used for planning purposes, drilling control purposes, or both planning and drilling control purposes. Integration of bore planning software is simplified because the bore plan information can be stored either by the downhole electronics or the drilling machine.

Turning now to the figures, and more particularly to FIG. 1, there is illustrated the overall system 10 of a horizontal directional drilling system in accordance with an embodiment of the present invention. The major components include a drilling machine 80, mud system 30, and a walk-over guidance system 800. The drilling machine 80 includes a power system 85, pipe handling system 20, stake down system 70, and strike alert system 90. The walk-over guidance system 800 includes an RF unit 800*a* mounted on the drilling machine 80, a locator 800*b*, and a sonde 800*c*. As discussed below, the RF unit 800*a* and/or sonde 800*c* can be considered part of, or excluded as part of, the walk-over guidance system 800 provided by a given walk-over system manufacturer. Potential operators include a drilling machine operator 40 and a locator operator 50.

Figure 2:
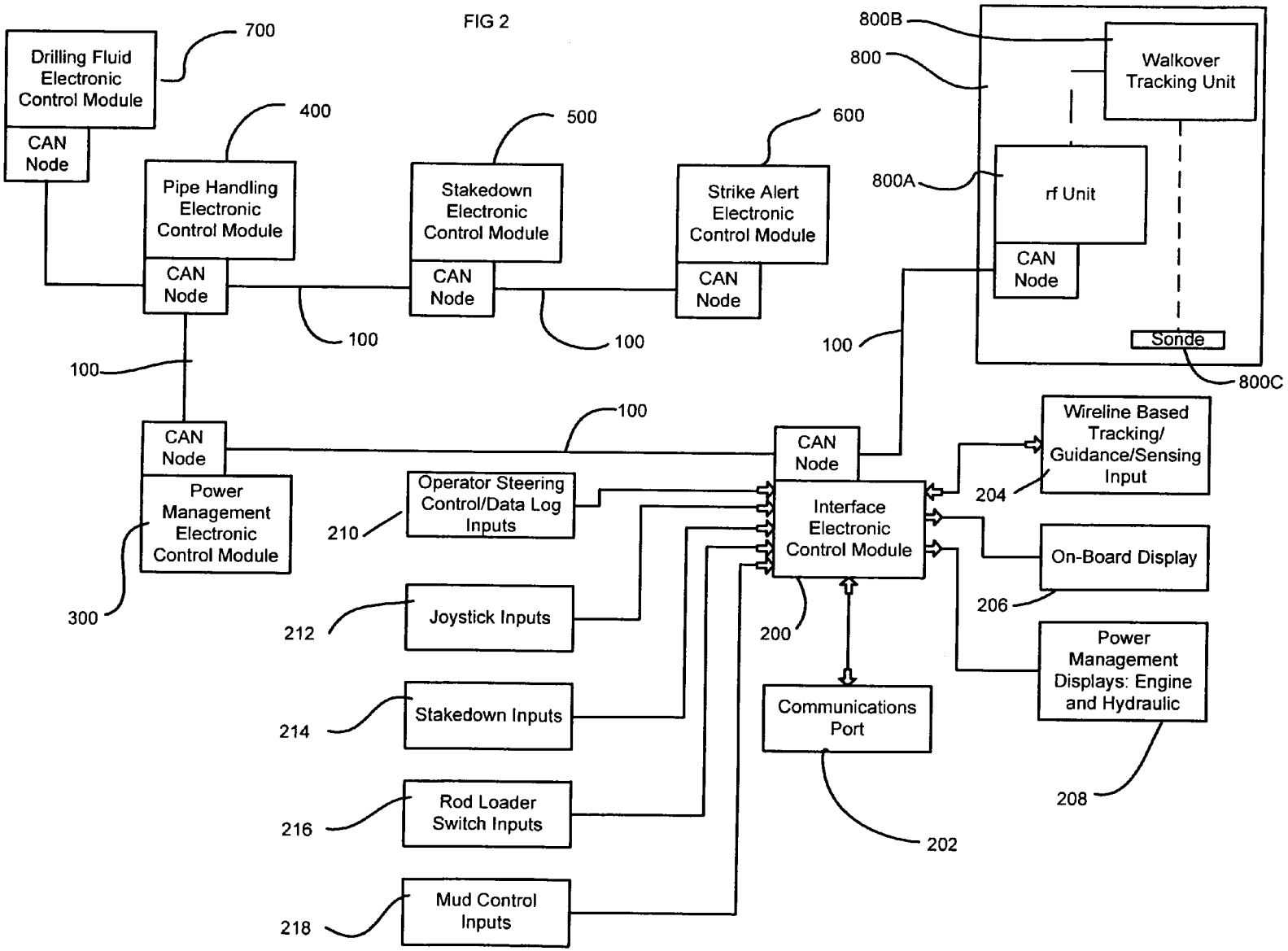
FIG. 2 illustrates various components and modules of a drilling system incorporating an interface architecture in accordance with an embodiment of the present invention, the modules communicating via a CAN network according to a particular configuration.

FIG. 2 illustrates a block diagram of the electronic control system for a drilling machine 80 of the type depicted in FIG. 1. The overall control system includes a number of separate electronic control modules, which will be described in greater detail below. These modules are illustrated in FIG. 2 only for purposes of illustration, it being understood that the actual number and type of separate control modules, referred to interchangeably herein as controllers, and their specific functionality depends on a given design implementation. Moreover, it is understood that the functionality of several or all of the modules can be incorporated in a single control module, controller or processor.

Communication between the controllers can utilize any number of data linking techniques. Examples of such techniques include those disclosed in U.S. Pat. No. 6,202,012, which is hereby incorporated herein by reference in its entirety. For this particular embodiment, the data link 100 is implemented to comply with an industry standard known as CAN. CAN is based on an ISO standard (ISO 11898) for serial data communication. The protocol was developed aiming at automotive applications. Today, CAN has gained widespread use and is used in industrial automation as well as in automotives and mobile machines.

Figure 2A:
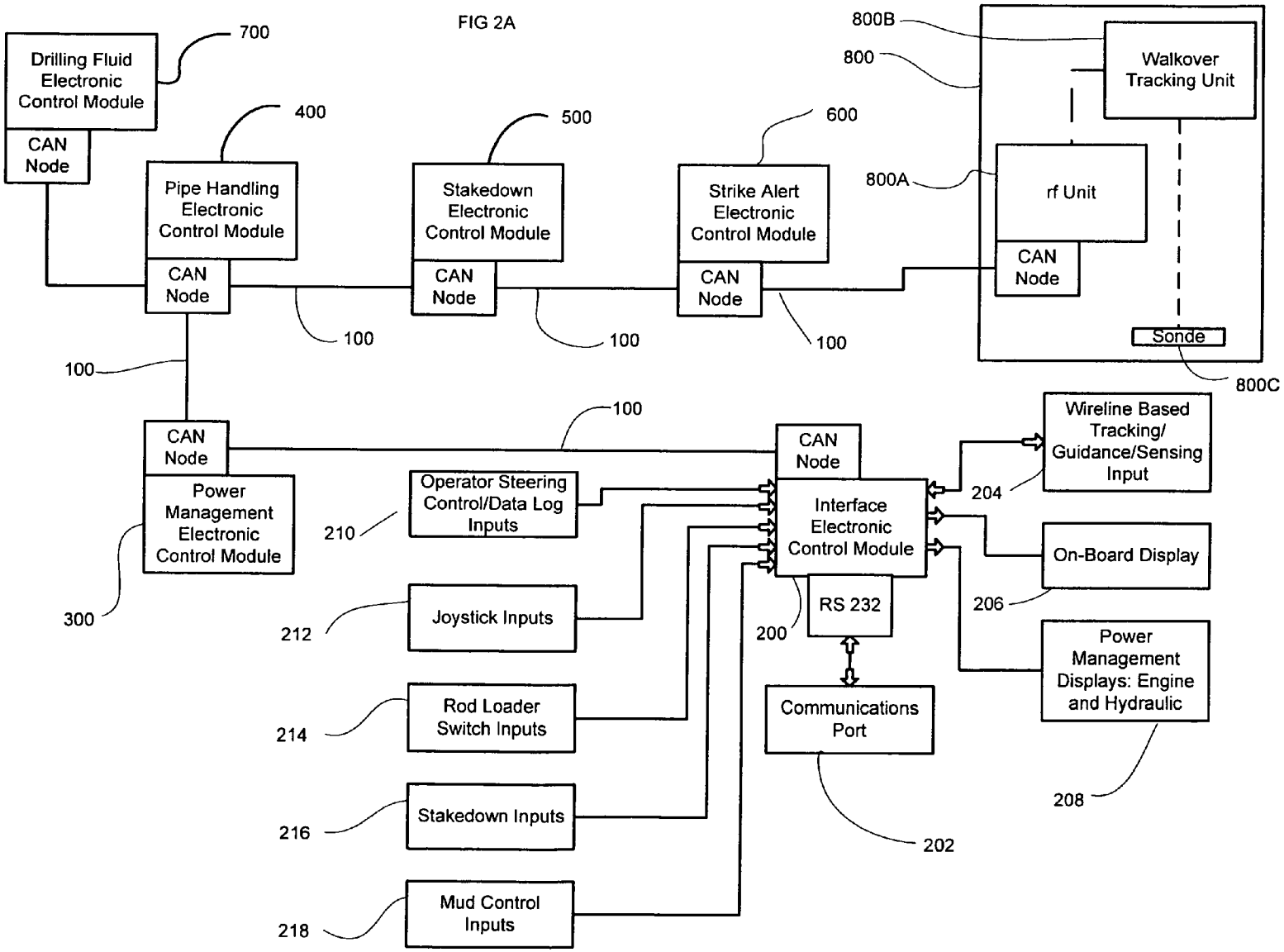
FIG. 2A illustrates various components and modules of a drilling system incorporating an interface architecture in accordance with an embodiment of the present invention, the modules communicating via a CAN network and an interface module of the system communicatively coupled to a communications port via an RS 232 interface.

FIG. 2A illustrates an alternative block diagram of the electronic control system. In this implementation, electronic control modules similar to those shown in FIG. 2 are connected to a CAN bus, with the exception that there is a specific electronic control module (ECM) for tracking and guidance. This ECM is capable of interfacing with various drill head based guidance systems and with various walk-over guidance systems through a standard or proprietary protocol. The ECM is linked to the rest of the control system through the CAN bus such that drill machine control signals can originate at the walkover locator and effect functions of the drill, and other signals can originate at the drill and effect changes at the walk over locator. In this embodiment, the communications link between the drill and the locating system(s) is a CAN bus, between the component of the locating systems on the machine that is standard, the interface ECM, and the component of the locating systems that is unique to a specific locator, the RF unit, can be some other form, such as USB or RS485.

Figure 2B:
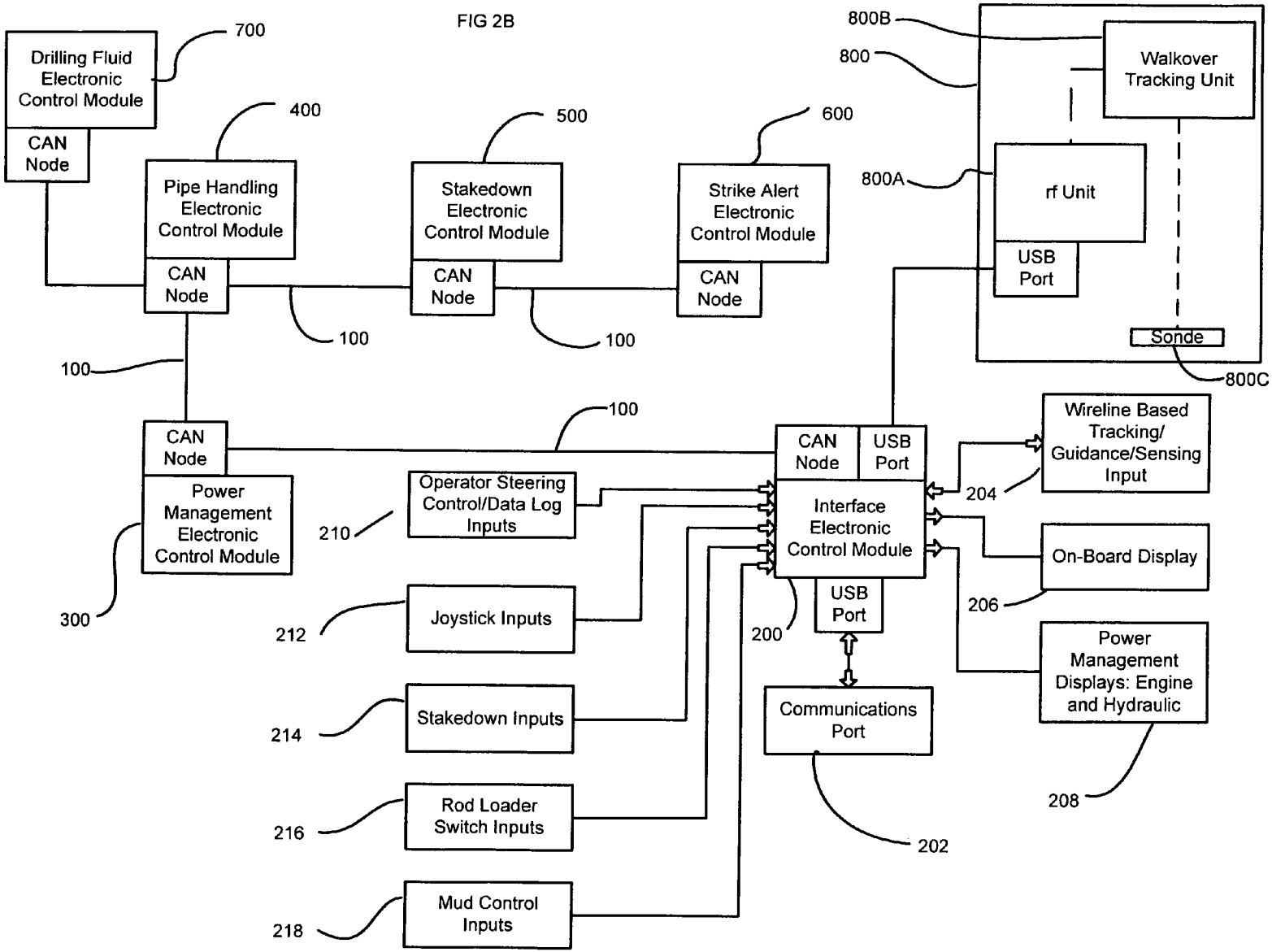
FIG. 2B illustrates various components and modules of a drilling system incorporating an interface architecture in accordance with an embodiment of the present invention, the modules communicating via a CAN network and an interface module of the system communicatively coupled to a communications port and an RF unit of a walk-over tracking system via a USB interface, respectively.

For example, and with reference to FIG. 2B, there is shown another embodiment of an electronic control system that employs an interface (e.g., USB interface) for facilitating communication with a guidance and tracking system 800 that is different or separate from the network link (e.g., CAN) that provides for communication between the various ECMs (e.g., nodes) of the system. In the particular configuration shown in FIG. 2B, the guidance and tracking system 800 interfaces with the interface ECM 200 via a USB port, it being understood that an interface/protocol different from that of a USB port can be used. Further, the system may incorporate more than two different types of communication links and communication protocols for achieving optimal communications (e.g., requisite data transfer rate and reliability) with the various internal and external systems.

According to the embodiment of FIG. 2B, the unique or separate interface between the guidance and tracking system 800 and the interface ECM 200 provides for a sufficiently high data transfer rate between these system elements. Providing this unique or separate communication link also increases the integrity of machine control signaling within the system's communication network (e.g., CAN) effectively isolating intra-system machine ECM communications from communications between the system and guidance and tracking system 800. This separation can be effected in several ways, including: (1) employment of different communication links each associated with a different communications protocol; (2) employment of different communication links each associated with the same communications protocol; or (3) employment of the same communication link(s) but effecting the desired separation by use of a different communications protocol.

The components illustrated in the figures are representative of components that can be combined in ways to develop a variety of systems or sub-systems that can be used with a horizontal drilling machine, although the specific arrangement could vary as needed or desired. In the embodiment depicted in FIG. 2, for example, an interface ECM 200, which may also be referred to as the on-board display unit, is shown, which provides an interface for the operator of the drilling machine and other external electronic components. It also serves as an information control hub wherein raw information from a variety of sources may be routed, the information manipulated and useful information transmitted back out for various uses.

Other external electronic components, such as a lap-top computer or other type of electronic component (e.g., a PDA, network interface card (NIC) interface) can be connected at the communications port 202. This port 202 can be configured according to the RS232 standard, to the CAN standard or any other common communications standard. Communications port 202 is utilized to transfer diagnostic data in real time or in a batch mode, allowing problems with the power systems of the drill or any sensor or component that is tied into the control system to be investigated and fixed, or to download software updates and/or operational data, such as a bore plan. Actual bore plan data, drilling machine/tool performance data, geographical data, and geophysical/geological data may, for example, be communicated to a remote system via communications port 202 in real time or in a batch mode. Possible embodiments for accommodating these data are shown in FIGS. 2-2B.

Another potential external electronic component that can be connected at the communications port 202 is a wire line based tracking system 204. This system 204 provides tracking data, and can be a direct connection to transducers and/or a communications connection to a separate ECM that manipulates data from the transducers and feeds the reduced data to the interface ECM 200. The definition of the communications protocol related to this input can enable the interface ECM 200 to communicate with a variety of manufacturers of wire line based tracking systems. The term "wire line" system in this application is intended to cover all systems wherein a drill head tracking system is installed in the drill head with data being transferred through the drill string. By way of example, U.S. Pat. No. 5,467,832, which is hereby incorporated herein by reference, describes methods used to transfer data through the drill string, other than an actual wire. For purposes of this description, the term wire line system is meant to include any drill string data transfer system.

An important component of a given system is an on-board display 206 of some type. This display 206 provides for displaying of information related to the guidance systems and various aspects of the overall system performance and status. The on-board display 206 is capable of providing such information in a variety of formats, typically corresponding to the data format associated with the tracking and guidance system 204 or 800, the specific pipe handling system 20, the specific stake down system 70, and/or the specific drilling mud system 30 being utilized. Thus, this display 206 is configured to potentially provide similar information in a variety of formats, as appropriate for the specific tracking and guidance system being used.

The power management displays 208 can be separate or integrated into the on-board display 206. However, it has been found that for many indicators of machine status, such as engine oil pressure, engine rpm, flow rates, etc., individual analog gauges are generally preferred by operators. For this reason, the power management displays 208 are preferably dedicated analog displays. They may be driven electrically or digitally, but preferably resemble an analog gauge. The on-board display 206 may include some type of warning indication, such that if a power management parameter is outside a normal operation range, a warning is displayed to direct the operator to check the other power management display(s) 208. In this manner, there may be multiple indicators for power management parameters, the on-board display 206, and the power management display(s) 208.

In addition to providing for various outputs, a number of operator inputs are provided. In this embodiment, the operator inputs are also associated with the interface ECM 200. These inputs include, for example, operator steering control inputs and data log inputs 210, joystick inputs 212, rod loader switch inputs 216, and stakedown inputs 214. Here again, these specific inputs are meant to be illustrative of one exemplary set of inputs, and certain systems may require fewer, more or other inputs.

The operator steering control inputs/data log inputs 210 are associated with the guidance and tracking system 800. A typical steering control input would be a command to steer the boring tool up a certain distance and to the right a certain distance within a certain length of bore/number of drilling rods. This command could be developed by the operator as a result of comparing the actual position of the bore, as displayed on the on-board display 206, or as displayed at the walk-over locator display, to the desired position according to the bore plan, also displayed.

The overall control system can then perform a guidance routine, where a recommended steering correction action can be generated. Various parameters can be utilized in generating the recommendation including the mechanical characteristics of the drill pipe being used, the historical capability of effecting changes as determined from recorded information during recent steering corrections, estimated soils entered by the operator, etc. This recommendation can be displayed in a manner indicating that the drill bit should be rotated to a clock position of 1:00 and then the drill pipe advanced without rotation for ½ of a rod length, for example. The system would then rely on the operator to effect this change. Alternatively, the system may include control software to effect the recommended change automatically, as is discussed below. With the system implemented in accordance with this embodiment of the present invention, the information could be entered by either the drill machine operator 40 or the locator operator 50, as identical information can be presented and identical operator inputs recognized at both locations.

Another option is for the drilling machine to automatically implement this steering action, either fully automatically, where there is no requirement for operator input, or partially automatically, where the operator is required to hold one joystick, at least away from their neutral positions.

The operator steering control and data log inputs 210 may be unique to the individual tracking systems 800, yet may be provided with a generic arrangement of switches. A specific decal may be designed to be installed around this generic arrangement of switches so that the decal associated with the specific tracking system being utilized could be installed to allow the operator to properly identify the switches.

The joystick inputs 212 are typically utilized for direct control of hydraulic system(s). Current drilling machines sold by Vermeer Manufacturing Company, for example, include 2 joysticks and a mode switch. In one mode of operation, the joysticks control the hydraulic systems that provide rotational torque and longitudinal thrust to the drill string, allowing the drilling operation to be controlled by the operator. In a second mode, the joysticks provide control of the ground drive tracks, allowing the machine to be propelled along the ground. These inputs are part of the interface ECM 200, and various operational routines may be utilized to coordinate these manual control inputs with other automated or semi-automated routines to provide the actual control signal to the hydraulics.

Other various operator inputs are also provided for, including rod loader switch inputs 216, stake down inputs 214, and mud control inputs 218. Each of these inputs allows the operator to control individual actions of the various components of the drill, as will be known to one skilled in the art, or to enable/disable automated or semi-automated sequences.

The remaining ECMs include a power management ECM 300, a pipe handling ECM 400, a stake down ECM 500, a strike alert ECM 600, a drilling fluid ECM 700, and a walk-over tracking ECM 800.

The power management ECM 300 is capable of providing required outputs to control the engine, the hydraulic pumps/motors, etc. The power management ECM 300 is also capable of providing the required inputs necessary to provide the feedback signals and monitoring signals required, including RPM sensors, pressure sensors, and temperature sensors, for example. Each different model of drilling machine will utilize different power components, requiring different outputs and inputs. The power management ECM 300 provides the interface between a standard protocol defining the required information that is to be communicated and the specific control or sensing signals associated with the specific components of the drilling machine.

The pipe handling ECM 400 is capable of providing required outputs to control various functions of the pipe handling apparatus, either with direct control from the interface ECM 200 or by some semi-automated or automated sequences. Here again, there may be various pipe handling mechanisms, with a variety of controlled elements. The pipe handling ECM 400 provides the interface necessary to provide a common communication protocol to the CAN network 100 with unique inputs and outputs as required by the individual mechanisms. One of the outputs of this ECM may be an identifier, which identifies the type of rod loader. Specific display characteristics may be enabled in response to this identifier. Specific control switch inputs may be required for the specific rod loader. The rod loader switch inputs 216 may be a generic arrangement of switches, with a specific decal designed to be installed around the switches to allow the operator to properly identify them. The same implementation specifics apply to the stakedown ECM 500, strike alert ECM 600, and the drilling fluid ECM 700.

The RF unit ECM 800*a* is shown as a component of the walk-over tracking system 800, and is a node on the CAN network 100. The RF unit ECM 800*a* is the interface that provides for integrating with a variety of walk-over tracking systems into a standard control system. One of the outputs of this ECM 800*a* is an identifier, which identifies the type of walk-over tracking system, such as by identifying the system in terms of manufacturer, model, software/hardware version, etc., depending on the level of specificity required to define system uniqueness. This identifier enables specific and possibly unique functionality in the interface ECM 200. The interface ECM 200 may, for example, store operational codes for all possible walk-over tracking systems, and enable the appropriate code based on this identifier.

The inputs associated with each unique walk-over tracking system 800, provided, for example, by the operator steering control/data log inputs 210, may also be unique. As previously described, a unique decal that interfaces to a generic arrangement of switches at the operator station may also be provided as a component of the overall walk-over tracking system. This decal can be installed on the generic arrangement of switches to allow the operator 40 to properly identify them. The displays provided on the on-board display 206 may also be unique to the specific walk-over tracking system. These specific displays can be enabled by the appropriate code stored in the interface ECM 200.

The types of information that may be transferred between the walk-over guidance systems and the drilling machine during the boring process (e.g., boring a pilot bore or back reaming) are illustrated as an example in Table 1 provided below. The data can be organized into categories including measured parameters, as-built recording or recorded parameters, generated parameters, and operator inputs, for example. It is noted that the information of Table 1 is provided for illustrative purposes only, and that the patents identified in Table 1 are hereby incorporated by reference in their respective entireties.

TABLE 1

| Feature - Information to be transferred between the walk-over guidance system and drilling machine | DCI (Mfg. #1) | McLaughlin (Mfg. #2) | Radio Detection (Mfg. #n) |
|---|---|---|---|
| | Measured Parameters | | |
| Pitch | X | X 5,469,155 | X |
| Roll | X | X 5,469,155 | X |
| Temperature | X | X | X |
| Depth | X | X 5,469,155 | X |
| Tension or Weight on Bit | X 5,961,252 | | |
| Distance from Utility | X 6,196,585 | | |
| On-Grade Bore Indicator | | | |
| Drill Head Steering Signal | | | |
| Electrical Strike | | | |
| Shock or Vibration at Bit | U.S. Pat. No. 5,467,832 discloses concept of monitoring vibration and subsequently making changes. | | |
| Fluid Pressure at Bit | | | |
| Hours of Use | | | |
| Environment Sensor, such as hydrocarbon sensor | U.S. Pat. No. 5,467,832 discloses concept of monitoring vibration and subsequently making changes. | | |
| | As-Built Recording or Recorded Parameters | | |
| Compiled Depth Table | | X 5,711,381 6,102,136 | |
| Push Button to Record Depth | | X 5,711,381 6,102,136 | |
| Automatically record Depth when pipe is added: Automatically send depth requirement to locator requesting accurate depth measurement, locator operator then to confirm that depth reading is accurate | | | |
| | Generated Parameters | | |
| Recommended drilling action to achieve a desired steering correction/or status of automatic implementation of those actions | | | |
| Monitor ΔPitch during steering correction and provide recommendation | | | |
| Remote Lockout Verification Signal | | | |

TABLE 1-continued

| Feature - Information to be transferred between the walk-over guidance system and drilling machine | DCI (Mfg. #1) | McLaughlin (Mfg. #2) | Radio Detection (Mfg. #n) |
|---|---|---|---|
| | Operator Inputs | | |
| X-Back to Bore Plan or move a set distance ΔX | X 5,698,981 | | |
| Y-Back to Bore Plan or move a set distance ΔY | | | |
| Z-Back to Bore Plan or move a set distance ΔZ | | | |
| Thrust Control | X 6,079,506 6,279,668 | | |
| Rotation Control | X 6,079,506 6,279,668 | | |
| Lockout/Run Signal | | | |
| Steering Correction Parameters | | | |
| Modify Sonde Transmissions to improve communications | | | |
| Calibrate Sonde for clock position | | | |
| Calibrate Sonde for pitch | | | |
| Calibrate System to display clock position | | | |

Looking first at the measured parameters in Table 1 above, there is certain information that will be provided with all manufacturers of tracking systems (indicated by an "X"). This information includes: Pitch, Roll, Temperature, and Depth. In addition to these parameters, the remaining items left listed in Table 1 (blank items) are either already implemented in some form by one manufacturer (a patent discloses the subject manufacturers' particular implementation), a foreseeable request, or are examples of potential future developments. Some of these parameters may be provided using proprietary methods, while the actual parameter is generic. An example includes product tension, where methods of measuring and transmitting this information to the surface may be proprietary, while the actual data displayed may be generic. In this example, the on-board display 206 may include a generic symbol for this data.

Recent developments in drilling tools have resulted in the likelihood that some type of feedback signal directly from the tool, whether a backreamer or drilling bit, will be requested as part of the signal being generated from the sonde. These types of drill head signals can readily be handled by the system in a manner similar to those described above. It is also possible to transfer electrical strike warning information directly to the locator 800*b* as a result of the integration of the walk-over tracking system into the overall control system.

As-built information, which is included in Table 1 above, is currently being compiled by current walk-over tracking systems on the market. This data is collected in a variety of manners, but typically is recorded once per rod length, when a new drill pipe is being added to the drill string. The locator operator 50 performs a locate process in order to verify the location of the drilling tool and to enable an accurate depth reading. Once the locate is completed, the operator 50 must typically indicate the same, such as by pressing a button or some other indication to confirm that the depth measurement is accurate, and that the locator 800 is properly positioned to provide an accurate depth measurement.

Integration of the various systems as provided by the present invention allows the depth readings to be compiled as frequently as required or requested. This is enabled by the fact that the system is capable of determining a percentage of pipe insertion at any point, such as by being capable of accepting input from a pipe position transducer on the drilling machine. Thus, if a depth reading is to be compiled when a drill pipe is partially inserted, the request can be made by either the drill operator 40 or the locator operator 50. The drilling process will then be temporarily suspended while the locate process is completed and an accurate depth measurement enabled. Once the locate is complete, the locator operator 50 can verify, and the system records the depth and the percentage of insertion of the drill pipe. Those skilled in the art will recognize how this information can then be associated with the bore plan to generate comparative plots or other useful data.

With regard to the generated parameters of Table 1 above, these parameters can be developed and generated from either the drilling machine 80 or the walk-over tracking system 800 or possibly from the wire line control system that could provide input at the wire line based tracking input 204. One such generated parameter is a verification signal, generated by the drilling machine, and confirming a lockout condition as disclosed in U.S. Pat. No. 6,408,952 to Vermeer Manufacturing Company, which is hereby incorporated by reference in its entirety. Other possible generated outputs can include a recommended steering action of the status or a steering action and an indication of the results of a steering correction as can be determined by monitoring change in pitch. When making a steering correction in the vertical plane, the change in pitch is a reliable indication of progress of the steering change. If the steering change is in the horizontal plane, pitch is not affected and other feedback techniques could be developed. With a system of the present invention, this type of information can be generated and shared with various manufacturers of tracking systems.

Looking at the operator inputs in Table 1 above, these inputs can be entered by either the drill machine operator 40 or the walk over locator operator 50. The thrust and rotation control inputs are always available to the drill machine operator 40; the patents listed above for these inputs deal with the generation of these signals by the locator operator 50.

Entering parameters associated with specifying a movement back to bore plan can be accomplished either manually by either operator 40 or 50, based on the information presented, or can be determined by the walk-over tracking system as disclosed in U.S. Pat. No. 5,698,981, which is hereby incorporated by reference in its entirety. A lockout or run signal is preferably required, as disclosed in previously incorporated U.S. Pat. No. 6,408,952.

Either operator 40 or 50 can also enter steering correction parameters. Examples of these types of inputs are disclosed in previously incorporated U.S. Pat. No. 5,778,991 to Vermeer Manufacturing Company. The control system of the present invention provides a great benefit related to these techniques, in that the basic signals from the tracking systems are available to the control system to improve the implementation. One general approach to implementing an interface architecture that may be adapted for use in the context of the present invention is disclosed in U.S. Pat. No. 5,553,245, which is hereby incorporated by reference in its entirety.

Either operator 40 or 50 may additionally request that the sonde-walkover locator communication link be adjusted to improve accuracy of the locate or to improve the reliability of the communication. Modifications of this type are currently possible by operating the drill rig in a manner that the sonde sees a certain, and unusual predefined sequence, or a combination of events such as rotate to a certain orientation, stop, rotate again to a second orientation, stop. Any number of combinations may be programmed in the sonde, possibly with different combinations resulting in different changes to the communication.

Examples of the possible changes include the transmission frequency, the strength of the signal, and the baud rate. With the control system of the present invention, operators would not need to memorize these combinations. The requested change could simply be made, and the control system could recognize which sonde/walkover locator system is being used, and automatically implement the correct combination of actions at the drilling rig to modify the communication parameter within the sonde. At the same time, the drilling rig could signal the walk-over locator that this change was initiated to insure that the communication link's reliability is maintained and that the operating characteristics are appropriately adjusted to maintain the accuracy of the results. This would be particularly important in the instance the sonde has two transmission levels. The measured depth is affected by the transmission level, thus the sonde and locator need to be coordinated in order to assure accurate depth measurement.

In addition, the operator may wish to calibrate the sonde to transmit a calibrated pitch or roll position or, alternatively, the locator and remote display may be calibrated to receive a raw signal from the sonde, which is modified to generate a calibrated display. These features reduce the demands on the sonde mounting.

The rotary orientation of the sonde is typically keyed to the sonde housing. This is typically done in coordination with the drill bit's connection to the sonde housing, such that the sonde's orientation correctly indicates the steering characteristic of the drill bit. As drill bits continue to evolve, the number of different physical configurations of the sonde housings is expanding. The requirement is simply that the clock position indicated to the operator signify the position of the drill head.

An alternative to physically coordinating the components is to utilize a calibration method. This method includes having the drill head assembled, with the sonde locked in a random rotary position, the operator positioning the drill head to a known clock position, and then performing a calibration step. This calibration step could include a combination of movements as previously described that would effectively reprogram the sonde to transmit that known clock position.

Another alternative would be for the sonde to continue transmitting the same raw signal, this raw signal being received by the walkover locator and transferred to the remote unit. The remote unit, having been manipulated by the drill rig operator, knowing the actual clock position of the drill head, can convert the raw clock position received from the sonde into a calibrated clock position. This calibrated clock position can then be displayed to the drill rig operator or the walk-over locator operator.

These same techniques can be implemented in calibrating the pitch reading in order to compensate for variations in pitch measurements inherent with sondes or in the mounting variations of the sondes within the sonde housings. Here again, the sonde itself can be calibrated to produce a calibrated output, or the walkover locator and remote units can be utilized to receive a raw signal from the sonde and subsequently produce a calibrated output to the operators.

One advantage inherent with the architecture of the present invention according to certain embodiments is that the functionality provided to the drill rig operator is identical, independent of which locator system is being utilized. In fact, the locator systems can be either walk-over systems or wire line systems.

Figure 3:
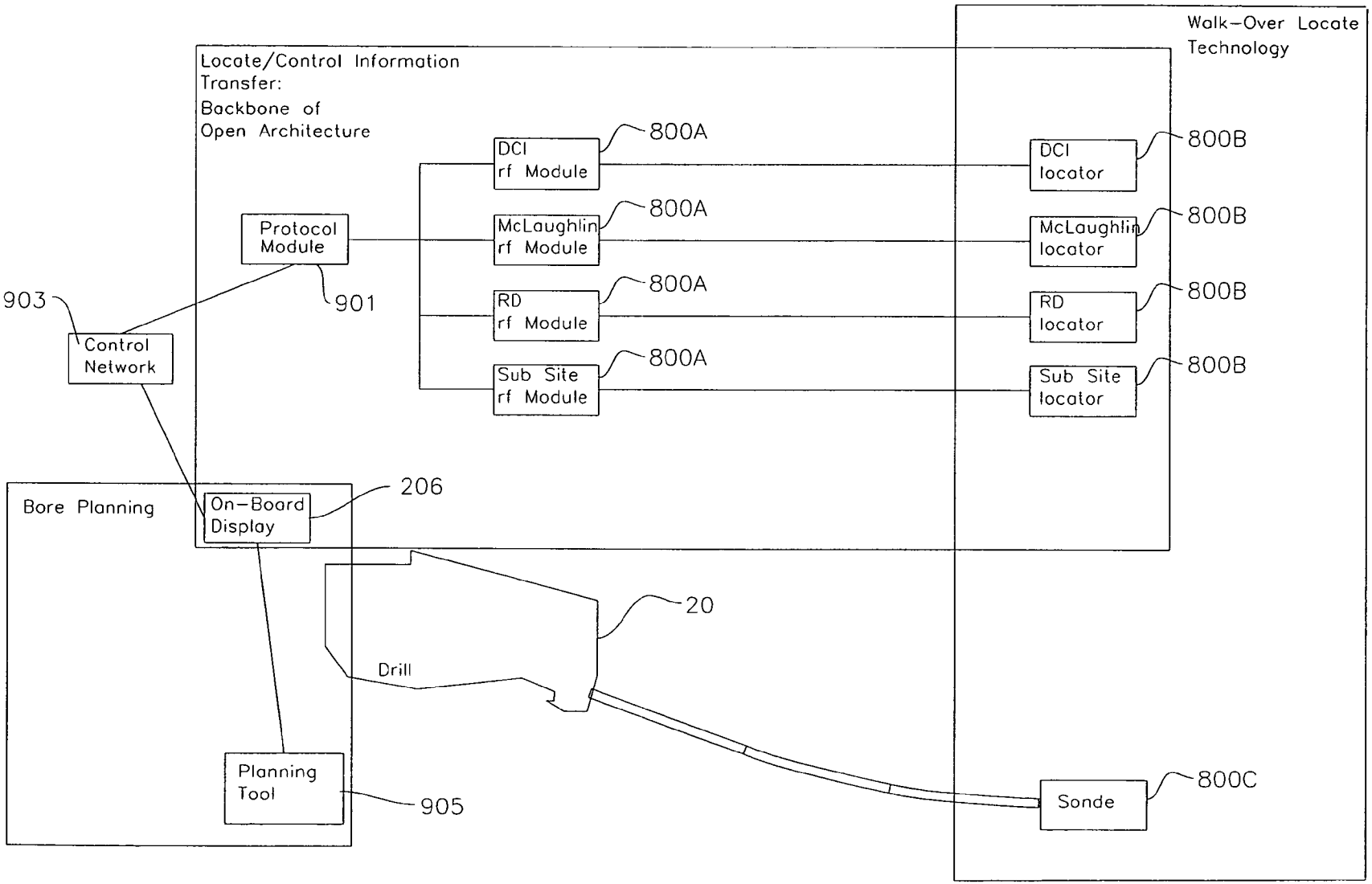
FIG. 3 illustrates a block diagram of a drilling system which incorporates an interface architecture for integrating any of a multiplicity of disparate walk-over locator systems in accordance with another embodiment of the present invention.

Referring now to FIG. 3, there is illustrated a system level diagram depicting a common interface architecture that provides for seamless integration between several disparate walk-over guidance systems and a particular drilling machine in accordance with an embodiment of the present invention. In one configuration, the walk-over system provided by a given manufacturer includes three components: a walk-over locator, an RF transceiver module mounted to the drilling machine; and a sonde disposed in the cutting tool.

In another configuration, the walk-over system provided by a given manufacturer includes two components: a walk-over locator and a sonde disposed in the cutting tool. In this configuration, the RF transceiver module is provided by the drilling machine manufacturer as a "factory-installed" component on the drilling machine. In a further embodiment, the walk-over system provided by a given manufacturer includes only the walk-over locator, and the RF transceiver module and sonde are provided by other manufacturers, which may include the drilling machine manufacturer.

The common interface architecture shown in FIG. 3 provides for integration between one or more disparate walk-over guidance systems 800 and a particular drilling machine 80. In the embodiment depicted in FIG. 3, the walk-over guidance system 800 provided by a given manufacturer includes a walk-over locator 800*b*, an RF transceiver module 800*a* mounted to the drilling machine 80, and a sonde 800*c* disposed in or proximate the cutting tool. In general, a contractor or other user of the drilling machine 80 will have selected one of the four walk-over guidance systems 800 shown for illustrative purposes in FIG. 3.

As is further shown in FIG. 3, four walk-over guidance system manufacturers are represented, each providing walk-over guidance system components that differ from other manufacturer's components in terms of one or more of operation, functionality, features, signaling protocol, and/or type of data acquired, processed, and transferred, among other potential differences. It is assumed that each of the walk-over guidance systems 800 includes a locator 800*b* that communicates with a sonde 800*c* and an RF module 800*a* in a unique manner relative to other walk-over guidance systems 800 shown in FIG. 3.

Location data, position/orientation data, various sensor data, drilling machine data, bore plan data, control signals, diagnostic data, and other information is communicated between the respective locator 800*b*/sonde 800*c*/RF module 800*a* system components and the drilling machine 80 via a protocol module 901. The protocol module 901, which may be implemented in one or more of the electronic control modules shown in FIG. 2 or a separate module(s), includes an input/output translation or conversion capability that provides for seamless interfacing of the above-described data and information as between a particular walk-over guidance system 800 and the control network 903 of the drilling machine 80.

The protocol module 901, in one embodiment, automatically recognizes the type of walk-over guidance system 800 being used by the operator. An identification code protocol may be used for this purpose, by which coded ID data is transmitted by a component of a given manufacturer's walk-over guidance system 800 (typically the locator 800*b*) to the protocol module 901. The coded ID data may, for example, represent header bits or other ID data embedded in locator data or in a configuration signal communicated from a component of the walk-over guidance system 800 to the drilling machine 80. The protocol module 901, in response to receiving the coded ID data/signal, adaptively transitions to a mode appropriate for converting a particular walk-over guidance system data/signaling protocol to a common protocol employed by the control network 903. In a similar, but reverse, manner, the protocol module 901 converts data/signals transmitted by the drilling machine's control network 903 (i.e., in the common protocol) to a form appropriate for the particular walk-over guidance system 800 deployed in the field.

The protocol module 901, in one embodiment, stores several protocol libraries corresponding to the various walk-over guidance system configurations likely to be used with a given drilling machine 80. Upon detecting ID data that identifies a particular walk-over guidance system, such as by one or more of the manufacturer, model, version, functional features, etc., the protocol module 901 accesses the pre-programmed protocol library associated with the identified walk-over guidance system. Protocol conversion is performed using input/output mapping or other interfacing/converting techniques operating on the accessed protocol library parameters. Updates to a given walk-over guidance system's protocol library, typically due to system improvements or software upgrades, may be accomplished in the field, such as by downloading such updates to the protocol module 901 locally (e.g., by CD-ROM) or remotely (via wireless or land line link) via a communications port, as is shown in FIG. 2, for example.

According to another embodiment, the protocol module 901 need not store all possible protocol libraries and updates likely to be employed by a particular drilling machine 80. Rather, the protocol module 901 may communicate with an Application Service Provider (ASP) via a web connection (typically wireless connection) to obtain and download the necessary protocol libraries and/or library updates. Prior to use, a connection can be established with the ASP and a check can be made to ensure that the protocol module 901 is operating with the most current protocol library associated with a particular walk-over guidance system 800 used at the job site. If the status check indicates that a more current protocol update exists and is recommended for a particular job, the most current protocol update can be downloaded from the ASP to the protocol module 901 via the web connection prior to initiating drilling operations at the job site.

The protocol module 901 cooperates with the control network 903 to provide required, requested, or desired data for presentation on the on-board display 206 at the drilling machine 80. A bore planning tool 905 is accessible by the operator. The operator interacts with the bore planning tool 905 using a user interface provided at the drilling machine 80. Alternatively, or in addition, the operator may use a PDA loaded with bore planning software to plan, revise, access, or otherwise interact with a given bore plan established for a given job site.

A system and method of the present invention provide for a number of advantageous features not presently available in current implementations. For example, provision of a control system for horizontal drilling systems which includes individual electronic control modules each potentially capable of providing an identification code that allows the overall system to coordinate and integrate a variety of differing systems into an overall functional system represents a significant advancement in the art.

The above description of the present invention is not intended to describe each embodiment or every implementation of the present invention. Advantages and attainments, together with a more complete understanding of the invention, will become apparent and appreciated by referring to the detailed description provided above and claims taken in conjunction with the accompanying drawings.

What is claimed is:

1. A system for interfacing an earth moving machine with a plurality of disparate components adapted for use with the earth moving machine, comprising:

an interface controller;

a plurality of component controllers associated with the plurality of disparate components adapted for use with the earth moving machine;

a network communicatively coupling the interface controller and at least some of the plurality of component controllers using a first communication protocol, at least a particular component controller of the plurality of component controllers configured to effect communications using a second communication protocol differing from the first communication protocol; and a protocol module coupled to the interface controller and configured to effect protocol conversion between the first and second communication protocols, the protocol module implementing protocol conversion to facilitate communication between the interface controller and the particular component controller.

2. The system of claim 1, wherein the protocol module is configured to effect protocol conversion of the first communication protocol to the second communication protocol to facilitate communication from the interface controller to the particular component controller.

3. The system of claim 1, wherein the protocol module is configured to effect protocol conversion of the second communication protocol to the first communication protocol to the facilitate communication from the particular component controller to the interface controller.

4. The system of claim 1, wherein the protocol module is configured to:

effect protocol conversion of the first communication protocol to the second communication protocol to facilitate communication from the interface controller to the particular component controller; and effect protocol conversion of the second communication protocol to the first communication protocol to the facilitate communication from the particular component controller to the interface controller, thereby effecting bi-directional communication between the interface controller and the particular component controller.

5. The system of claim 1, wherein the second communication protocol differs from the first communication protocol in terms of at least one of data transfer rate, reliability, signaling protocol, type of data transferred, power requirements, input/output requirements, standards specification compliance, and connection interface.

6. The system of claim 1, wherein a network connection between the interface controller and the at least some of the plurality of component controllers using the first communication protocol defines an intra-system network that is effectively isolated with respect to a network connection between the interface controller and the particular component controller.

7. The system of claim 1, wherein at least one of the first and second communication protocols comprises a CAN protocol.

8. The system of claim 1, comprising a protocol library accessible to the protocol module, the protocol library configured to store for, or provide to, the protocol module a plurality of disparate communication protocols comprising at least the first or second communication protocol.

9. The system of claim 1, comprising a protocol library accessible to the protocol module, the protocol module configured to select the second communication protocol appropriate for the particular component controller in response to determining that the particular component controller is not configured to effect communications using the first communication protocol.

10. The system of claim 1, wherein the interface controller comprises a communications interface configured to effect communications with a device or system external to the earth moving machine.

11. The system of claim 1, wherein the interface controller comprises a communications interface configured to effect communications with a earth moving component connectable to the earth moving machine.

12. The system of claim 1, further comprising an on-board display provided at the earth moving machine, the interface controller configured to cooperate with the on-board display to present data acquired from the at least some of the plurality of component controllers using the first communication protocol and the particular component controller configured to effect communications using the second communication protocol.

13. A method for interfacing an earth moving machine with a plurality of disparate components adapted for use with the earth moving machine, comprising:

providing a plurality of component controllers associated with the plurality of disparate components;

effecting communication between each of the plurality of component controllers and an interface controller of the earth moving machine via a network, at least some of the plurality of component controllers using a first communication protocol to effect communications with the interface controller via the network and at least a particular component controller of the plurality of component controllers configured to effect communications via the network using a second communication protocol differing from the first communication protocol; and performing protocol conversion between the first and second communication protocols to facilitate communication between the interface controller and the particular component controller.

14. The method of claim 13, comprising one of:

effecting protocol conversion of the first communication protocol to the second communication protocol to facilitate communication from the interface controller to the particular component controller; and effecting protocol conversion of the second communication protocol to the first communication protocol to the facilitate communication from the particular component controller to the interface controller.

15. The method of claim 13, comprising:

effecting protocol conversion of the first communication protocol to the second communication protocol to facilitate communication from the interface controller to the particular component controller; and effecting protocol conversion of the second communication protocol to the first communication protocol to the facilitate communication from the particular component controller to the interface controller, thereby effecting bi-directional communication between the interface controller and the particular component controller.

16. The method of claim 13, wherein the second communication protocol differs from the first communication protocol in terms of at least one of data transfer rate, reliability, signaling protocol, type of data transferred, power requirements, input/output requirements, standards specification compliance, and connection interface.

17. The method of claim 13, wherein a network connection between the interface controller and the at least some of the plurality of component controllers using the first communication protocol defines an intra-system network that is effectively isolated with respect to a network connection between the interface controller and the particular component controller.

18. The method of claim 13, comprising accessing a protocol library for performing protocol conversion, the protocol library storing or providing a plurality of disparate communication protocols comprising at least the first or second communication protocol.

19. The method of claim 13, comprising communicating with a device, system or component external or connectable to the earth moving machine.

20. The method of claim 13, comprising displaying, at least at the earth moving machine, data acquired from the at least some of the plurality of component controllers using the first communication protocol and the particular component controller configured to effect communications using the second communication protocol.

* * * * *